United States Patent [19]

Gerch

[11] Patent Number: 4,470,620

[45] Date of Patent: Sep. 11, 1984

[54] LEAFED HOLDER FOR WRITING PAD, PAPERS AND ACCESSORIES

[75] Inventor: Edward L. Gerch, Chicago, Ill.

[73] Assignee: Kingport, Ltd., Evanston, Ill.

[21] Appl. No.: 403,534

[22] Filed: Jul. 30, 1982

Related U.S. Application Data

[63] Continuation-in-part of Ser. No. 361,624, Mar. 25, 1982.

[51] Int. Cl.[3] ..... B42D 3/00

[52] U.S. Cl. ..... 281/31; 281/30; 281/29; 190/11

[58] Field of Search ..... 281/29, 30, 31; 190/11, 190/42, 48, 51, 900, 901, 902, 109; 150/0.5, 35, 52 B

[56] References Cited

U.S. PATENT DOCUMENTS

| | | | |
|---|---|---|---|
| 1,491,807 | 4/1924 | McLinn | 190/11 |
| 2,213,821 | 9/1940 | McCurdy | 190/51 |
| 3,082,049 | 3/1963 | Lifton | 190/11 X |
| 3,104,289 | 9/1963 | Segel | 190/11 X |
| 3,123,190 | 3/1964 | Lifton | 190/42 X |
| 3,306,405 | 2/1967 | Rosenblum | 190/51 |
| 3,833,098 | 9/1974 | Alderman | 190/1 X |
| 4,255,872 | 3/1981 | Williams, Sr. | 281/30 X |

*Primary Examiner*—Donald R. Schran
*Assistant Examiner*—James Wolfe
*Attorney, Agent, or Firm*—James N. Videbeck

[57] ABSTRACT

A leafed holder for writing pad, papers and accessories includes a pair of like-sized covers retained together by an elongate hinge or spine connecting adjacent side edges thereof and a leafed member hingedly positioned between the covers and retained adjacent the spine, and having a substantially rigid planar surface on one side thereof adapted for use as a writing or organizing surface. A second surface of the leafed member opposite the writing surface includes document storage pockets thereon, and the leafed member is selectably closably retainable with one of the covers in a manner to keep documents retained therebetween.

6 Claims, 5 Drawing Figures

LEAFED HOLDER FOR WRITING PAD, PAPERS AND ACCESSORIES

BACKGROUND OF THE INVENTION

This application is a continuation-in-part of application Ser. No. 361,624 filed Mar. 25, 1982.

The invention relates generally to document holders for retaining writing pads, papers and accessories thereon, and more particularly, to a hinged document holder having a relatively rigid leaf member interposed between the opposing covers of same which is capable of providing a substantially rigid writing surface for a user.

The attache case has long been a business accessory in which persons carried papers and other documents in an organized mobile manner for use in their work. The weight and bulk of attache cases varies, but a common minimum thickness of such a case approximates two inches, and, in many cases, the weight of the attache case is greater than the weight of the documents carried therein. In order to lessen the weight of a document carrier, soft-sided portfolios have been introduced which contain a plurality of compartments adapted for holding papers and business accessories. However, the benefits of having a lightweight portfolio are often times offset by the lack of a relatively rigid surface on such portfolios for use in writing or organizing materials.

The following U.S. patents disclose document holders including a relatively rigid inner panel adaptable for for use as a writing surface: U.S. Pat. Nos. 3,082,049; 3,104,289; 3,112,017; 3,833,098; and 3,904,003. However, all these patents disclose cases of the attache type having opposing hollow half shell type members hinged together.

Additionally, portable paper pad holders have been formed which are light in weight and have a pair of articulated covers joined by hinge means therebetween. It is common for the inside surface of the back cover to be adapted for carrying a pad of paper thereon while the inside of the front cover includes a paper storage area. However, with a minimal amount of paper positioned in such a pad holder, no substantially planar relatively rigid surface is available as a clear surface upon which writing or organizing can be done by the person using same.

A need has developed for a lightweight document carrying holder having storage capacity for writing pads, papers and accessories therein, while also including a relatively rigid clear flat writing surface between the opposed covers of same.

It is, therefore, an object of the present invention to provide an improved paper holder for writing pads, papers and accessories.

Another object of the present invention is to provide a leafed holder for writing pads, papers and accessories having a clear, flat relatively rigid writing surface in connection with the leaf thereof for providing portable writing capability to the user or carrier thereof.

SUMMARY OF THE INVENTION

The invention is directed to a leafed holder for writing paper including a pair of generally planar covers having like-sized peripheries. A hinge is positioned between a side edge of each of the covers joining same for providing articulated movement therebetween. Engageable closures are positioned on each of the covers for maintaining the distal side edges thereof in selectably close proximation. Paper retaining means are positioned on an inside surface of at least one of the covers for retaining paper products positioned thereon. A form retentive leaf member is hingedly retained between the covers. A second closure on the leaf member and at least one of the covers is positioned for selectively maintaining the leaf member in close relation to that cover. The leaf member includes a substantially flat writing surface on one side thereof which is exposed when the second closure means is closed.

BRIEF DESCRIPTION OF THE DRAWINGS

The features of the present invention, which are believed to be novel, are set forth with particularity in the appended claims. The invention may best be understood from the following detailed description of a currently preferred embodiment thereof, taken in conjunction with the accompanying drawings, wherein:

DETAILED DESCRIPTION OF THE PREFERRED EMBODIMENT

Figure 2:
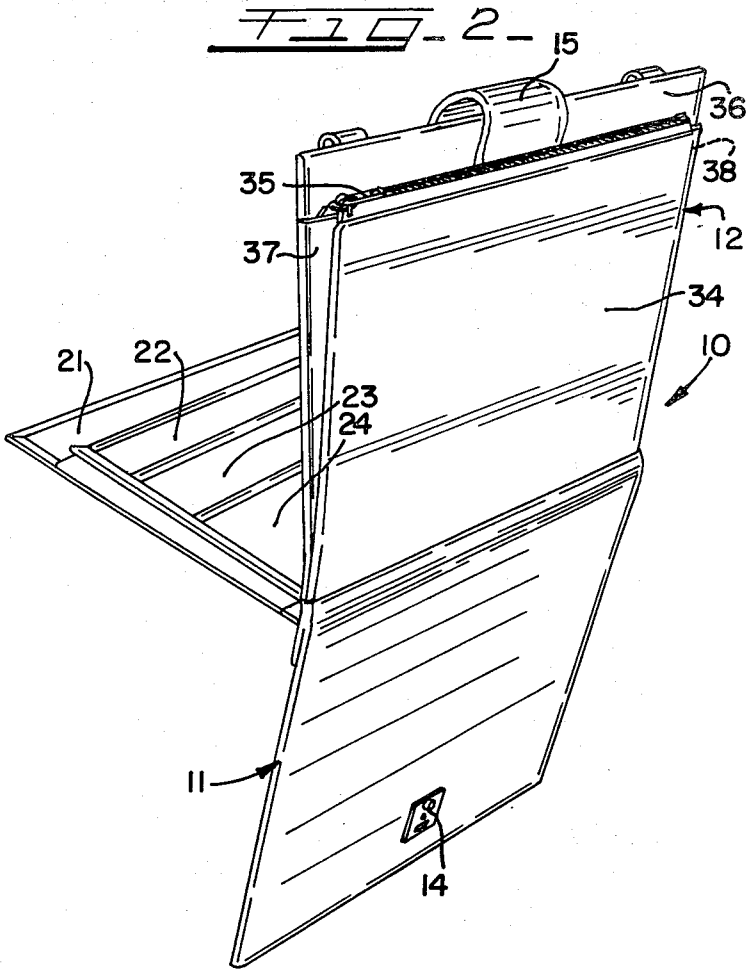
FIG. 2 is a perspective view of the leafed document holder in open position showing the outside of the covers and the multiple storage pocket side of the leaf.
Figure 1:
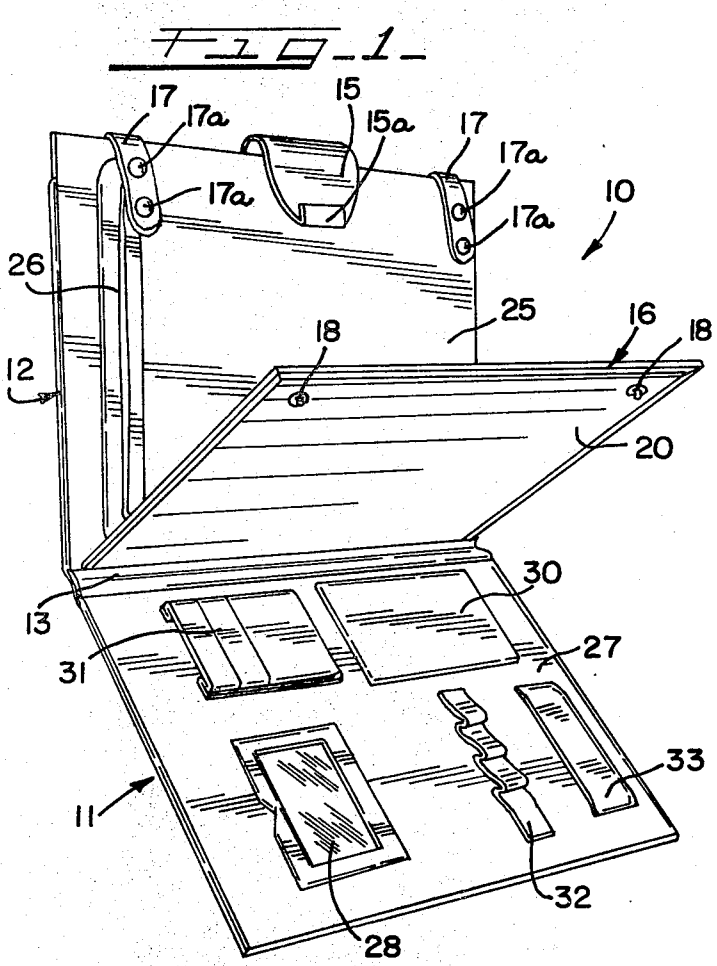
FIG. 1 is a perspective view of the leafed document holder constructed in accordance with the present invention in open position showing the interior side of both covers and the planar writing surface.

Referring to FIGS. 1–5, a leafed document holder 10, constructed in accordance with the present invention, includes a rectangular front cover, generally indicated at 11, and a rectangular back cover, generally indicated at 12, which is hingedly attached to cover 11 at elongate hinge or spine 13. The covers are lockingly retainable in close proximation with each other at their distal ends by means of locking mechanism 14 on cover 11 and strap 15 including clasp 15*a* at the distal end thereof mounted on cover 12. A preferred size for the front and back covers is 11¼ by 14 inches. A relatively rigid rectangular leaf member 16 is hingedly retained at hinge 13 to the document holder so as to be articulately movable between the covers thereof. Cover 12 includes a plurality of straps 17—17 extending outwardly of an outer distal side thereof. Each strap 17—17 includes a plurality of female snap members 17*a*—17*a* serially positioned for selective mating engagement and retention by male snap members 18—18 mounted adjacent the distal end of a substantially flat planar surface 20 on leaf 16.

Figure 3:
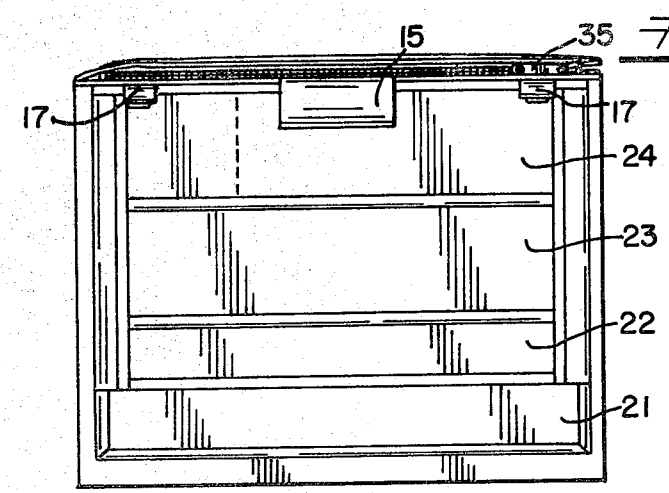
FIG. 3 is a top plan view of the leafed document holder shown in FIG. 1.
Figure 4:
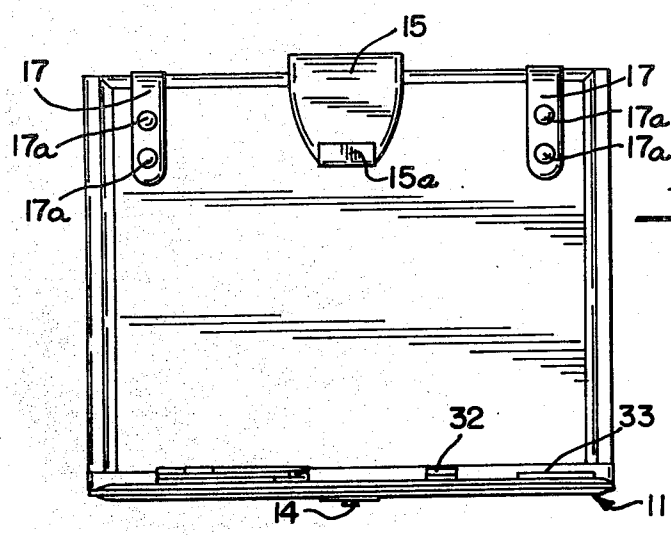
FIG. 4 is a side elevational view of the leafed document holder shown in FIG. 1 with the leaf in closed position over one cover thereof.

As shown most clearly in FIGS. 2 and 3, the opposing surface 21 of leaf 16 includes a plurality of differing sized pockets 22, 23 and 24 which are adapted to retain documents positioned therein. The inside surface 25 of cover 12 includes a slot 26 adjacent the top thereof which is adapted for receiving the cardboard backing of a pad of paper (not shown) and retaining same therein. Another preferred construction includes a biased clamp member (not shown) mounted on surface 25 which is adapted to retain paper sheets against that surface. It should be noted that the closure of the pair of snaps 17*a*–18 adapts the holder to retain a pad of paper on the inside of cover 12 and also retain any documents positioned in pockets 22, 23 or 24 on leaf 16 while providing a clear clean flat writing surface 20 for the user of the document holder. A preferred size for leaf 16 is 10½ by 13 inches.

The opposing inside cover surface 27 of cover 11 includes an identification or business card holding window 28, a medium sized pocket 30, a multi-pocket member 31, a pen/pencil holder strap 32, and an elongate pocket 33 positioned thereadjacent for receiving one end of the pens/pencils or for holding other documents or accessory items as desired. The combination of accessory pockets and pen/pencil retainer on surface 27 of front cover 11 retains any documents and/or accessories positioned thereon in organized fashion while allowing access to pens/pencils when the user of the document holder of the invention writes or conducts business utilizing the opposing flat surface 20 on leaf 16.

Figure 5:
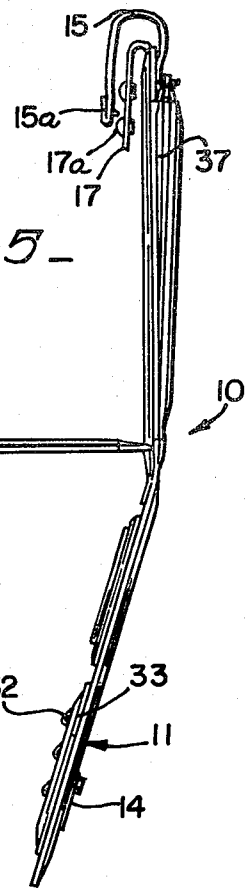
FIG. 5 is a side elevational view of the leafed document holder shown in FIG. 2.

As shown most clearly in FIGS. 2 and 5, an additional large pocket or file 34 is positioned on the back surface 36 of back cover 12 and has a top opening thereof which is selectably closable by slide fastener 35. Pocket 34 is a flat, relatively large file having webbed expandable siding 36–37 and is accessible through its opening without the need for opening the remainder of the document holder. A preferred size for pocket 34 is 10 by 14 inches.

A preferred material for the document holder is leather, vinyl, leather or vinyl bordered canvas, or the like. Linen or silk lining may also be preferred for interior surfaces. The leaf 16 is preferably reinforced for rigidity. The degree of rigidity of the cover may vary, although a soft outer feel to the cover is desirable. Latches 14–15*a*, and snaps 17*a*–18 are preferably made of brass, brass plated metal, other metal, plastic, or the like.

Thus, a uniquely adaptable and multi-purpose document carrier has been shown and described which includes an articulately hinged leaf member positioned between the front and back covers of same. The leaf member is adapted both to retain documents and to provide a smooth, flat, and relatively rigid writing surface for use by the carrier of the document holder. The leaf is retainable in close proximity by one of the covers to provide for retaining documents positioned in pockets between the leaf and that cover while still providing a substantially flat clear surfact for user writing or other business organizing, etc. on the flat surface.

While one embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. In a leafed holder adapted for carrying writing paper and other documents or writing accessories including a pair of generally planar covers having edges along substantially rectangular peripheries, hinge means between parallel opposed edges and joining each of said covers for providing articulated movement therebetween, parallel free peripheral edges extending generally perpendicular to said hinge edges in the plane of said covers, engageable closure means on each of said covers for maintaining the distal sides of same in selectably close proximation, means on an inside surface of at least one of said covers for retaining paper products thereon, and improvement comprising a form retentive leaf member hingedly retained between said covers, a substantially flat writing surface on one side of said leaf, and a document storage compartment on an opposing side of said leaf.

2. The leafed writing paper holder as defined in claim 1 wherein an inside surface of said cover immediately adjacent said side of said leaf having said document storage compartment thereon includes means for retaining at least on of a pad and a plurality of paper sheets thereon and whereon at least a portion of an outside surface of that cover defines one side of a closable opening in communication with said outside surface thereof.

3. The leafed writing paper holder as defined in claim 1 wherein an inner surface of said cover immediately adjacent said leaf writing surface includes a plurality of pockets for retaining business accessories therein and writing instrument retainers thereon.

4. An articulated, leafed document holder comprising:

a pair of generally planar covers having substantially like-sized rectangular peripheries, an elongate hinge extending along between and joining longer adjacent sides of said covers, opposed free peripheral edges in the plane of said cover thereof, said covers including a substantially soft outer surface thereof, a lock on said covers for maintaining the distal sides thereof in selected close proximity, said lock including a retaining means on an outer surface of one of said covers, and flap means extending from a distal side of the opposing cover including means for lockingly engaging said retaining means for maintaining said document holder closed, a form-retentive leaf member hingedly retained between said covers at said spine, a substantially flat writing surface on one side of said leaf, an opposing side of said leaf member including a document storage compartment thereon, an inside surface of said cover immediately adjacent said opposing side of said leaf including means thereon for retaining a plurality of paper sheets thereon, an inside surface of said cover immediately adjacent said leaf member writing surface including a plurality of pockets for retaining business accessories thereon, and an outside surface of at least one of said covers including an elongate opening for a document holding compartment on said cover which is selectably accessible when said lock is engaged.

5. The leafed writing paper holder as defined in claim 1 wherein said leaf member and one of said covers include engageable closure means for selectably maintaining said leaf member and said one cover in selectively close relation.

6. The leafed writing paper holder as defined in claim 4 wherein said leaf member and one of said covers include engageable closure means for selectively maintaining said leaf member and said one cover in selectively close relation.

* * * * *